US005619825A

United States Patent [19]

Leroney et al.

[11] Patent Number: 5,619,825

[45] Date of Patent: Apr. 15, 1997

[54] GUTTER SCREEN

[76] Inventors: David W. Leroney, 412 Lake Shore Dr.; Brad E. Wideman, 414 Park Lane Dr., both of St. Clair, Mo. 63077

[21] Appl. No.: 590,593

[22] Filed: Jan. 24, 1996

[51] Int. Cl.[6] ..... E04D 13/076

[52] U.S. Cl. ..... 52/12; 248/48.1

[58] Field of Search ..... 248/48.1, 48.2; 52/12, 16; 210/162, 163, 164, 469, 473, 474

[56] References Cited

U.S. PATENT DOCUMENTS

| | | | |
|---|---|---|---|
| 1,597,503 | 8/1926 | Andrews . | |
| 2,175,521 | 10/1939 | Fry . | |
| 2,209,741 | 7/1940 | Sullivan et al. | 210/474 |
| 2,288,121 | 6/1942 | Cisar et al. . | |
| 4,607,465 | 8/1986 | Hopkins | 52/12 |
| 4,905,427 | 3/1990 | McPhalen | 248/48.1 |
| 4,907,381 | 3/1990 | Ealer . | |
| 5,040,750 | 8/1991 | Brant | 248/48.2 |
| 5,271,192 | 12/1993 | Nothum, Sr. et al. . | |

*Primary Examiner*—Michael Safavi
*Attorney, Agent, or Firm*—Robbins & Robbins

[57] ABSTRACT

A gutter screen is provided for building gutters having an outer edge with an inwardly turned lip and gutter supports attaching the gutter to the building. The screen has a straight downwardly sloping intermediate gutter covering section, substantially vertical rear portion biased against the rear of the gutter and gutter support and a front portion biased against the lip of the gutter and gutter support and extending underneath the lip in biasing relation. The intermediate gutter covering section terminates flush with the lip to provide a substantially co-extensive surface for the screen and the top of the gutter.

7 Claims, 2 Drawing Sheets

GUTTER SCREEN

BACKGROUND OF THE INVENTION

In the past there has been a long standing problem in preventing debris, such as leaves, twigs, grass fibers and the like from accumulating in gutters. Build-up of such debris can block the drainage flow to the downspout and cause damage to the gutter. Cleaning is difficult and troublesome whether done by the homeowner or professionals.

Various types of screens have been devised of one type or another. Such screens generally may be biased on top of gutter supports against the house or rear of the gutter at one end and under or over a front lip of the gutter to cover the gutter trough. The screens extend underneath the roof edge and in some cases have presented problems in arched screens of contributing to accumulations of debris under the edge and against the house and in other cases of presenting a portion of the screen above the lip of the gutter, presenting a protuberance which may contribute to dislodgement of the gutter as well as presenting an unsightly appearance.

SUMMARY OF THE INVENTION

By means of this invention, there has been provided a gutter screen which is simple in construction, easily installed and efficient in function in minimizing collection of debris under the edge of the roof. It is constructed in such a manner that it is strongly biased against and under the gutter lip and has a flush engagement therewith to eliminate any protuberance to minimize danger of dislodgement by accidental contact with foreign objects.

The screen is specially designed to present a downward slope underneath the edge of the roof to dump debris down over the front edge of the gutter and prevent accumulation of debris under the roof on top of the screen and against the wall of the house. A flush connection of the substantially flat main cover portion of the gutter over the gutter trough provides not only a pleasing uncluttered appearance but minimizes accidental contact with foreign objects or forces that might tend to cause dislodgement.

The screen is connected to the gutter by three abutting elements of the screen. The back of the screen is raised at the main section and has a downwardly depending rear section supported on top of a gutter support or stave and biased against the rear wall of the gutter and gutter support. A forward portion may be somewhat L-shaped and have a downwardly depending foot section which abuts against and is biased against the inwardly turned lip of the gutter. A leg portion fits into a corner of the gutter support and is biased against it under the lip of the gutter to form with the rear wall of the screen and the first portion, a three point biasing of the screen with the gutter. In modifications, the intermediate cover section may be crowned or bent to facilitate insertion of the screen or have a gutter support wall in the forward section with a joint or shoulder, which may be biased against the edge of the gutter lip with an end, which may be biased against the top of the gutter support and inside of the gutter.

The screen is easily flexed and installed or removed in the gutter as required. It is simply manufactured and provides a firmly anchored screen which covers the gutter trough and by the flush engagement with the lip of the gutter is pleasing in appearance and eliminates any protuberances likely to interfere with the gutter.

The above features are objects of this invention. Further objects will appear in the detailed description which follows and will be otherwise apparent to those skilled in the art.

For purpose of illustration of this invention a preferred embodiment is shown and described hereinbelow in the accompanying drawing. It is to be understood that this is for the purpose of example only and that the invention is not limited thereto.

IN THE DRAWINGS

DESCRIPTION OF THE INVENTION

Figure 1:
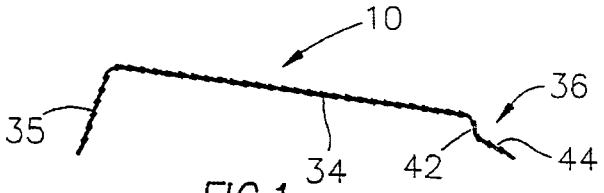
FIG. 1 is a view in side elevation of the gutter screen.
Figure 2:
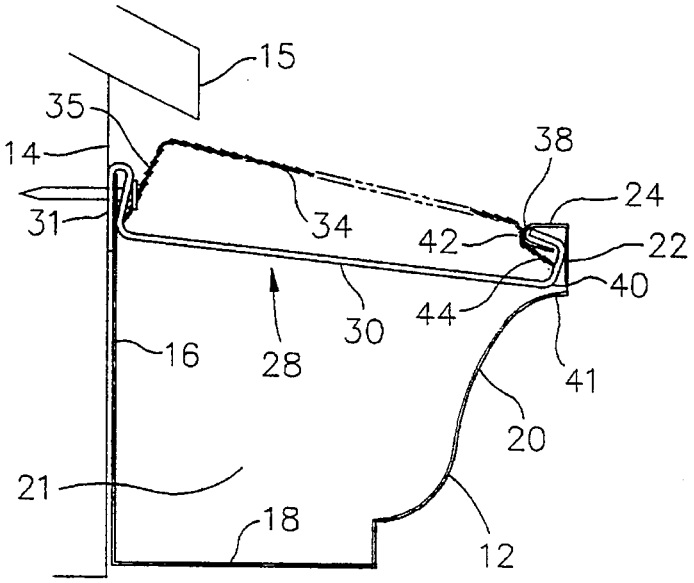
FIG. 2 is a view in cross-section of a gutter provided with the gutter screen.
Figure 3:
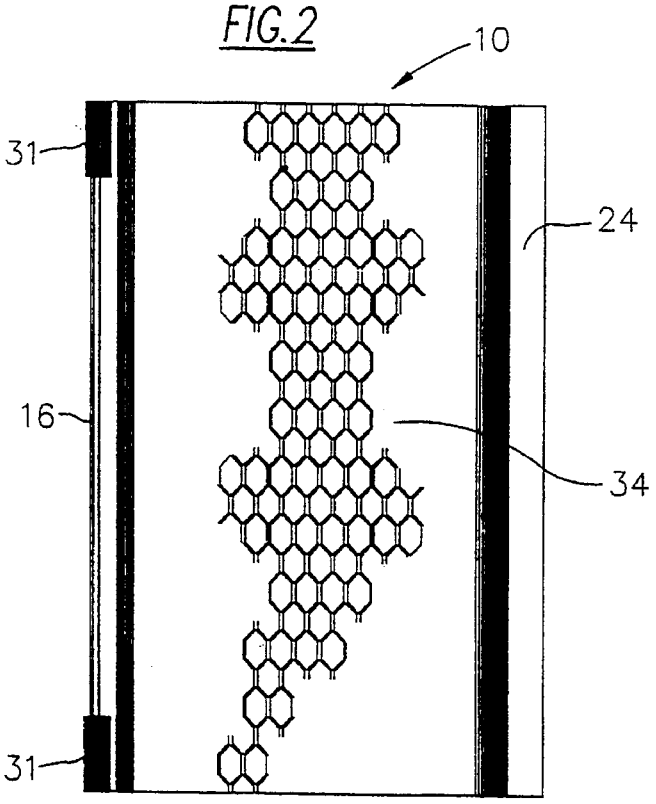
FIG. 3 is a top plan view of the gutter and screen.

The gutter screen of this invention is generally indicated by the reference numeral 10 in FIGS. 1, 2 and 3. It is shown installed in a gutter 12 attached to the side wall 14 of a building provided with an overhanging roof 15.

The gutter 12 is of a conventional "K" style and has a back wall 16, a bottom wall 18, a front wall 20 forming a trough 21. The front wall has an upper somewhat cup-shaped wall portion 22, terminating in an inwardly turned lip 24.

The upper front wall cup-shaped portion receives a J-shaped end 26 of a gutter support 28 which is adapted to nest inside the upper front wall of the gutter under the lip 24. The gutter support has an elongated stiffening portion 30 terminating in a U-shaped portion 31 adapted to fit over the top of the back wall 16 of the gutter and be nailed to the wall 14 of the building to support the gutter.

The gutter and gutter supports, which may be spaced at two foot intervals, are conventional and form no part of this invention, per se. The gutter screen 10 of this invention is particularly adapted to be connected and nest within the gutter and gutter support in a biased relation requiring no fasteners.

The gutter screen 10 is formed of a flexible screen, preferably powder coated steel, aluminum or copper for a slight degree of flexibility, strength and freedom from rust. It is comprised of a main downwardly sloping cover section 34 which covers the open trough 21 of the gutter.

A rear section 35 extends downwardly at a slight angle toward the rear and may be slightly flexible to bias it toward the front of the gutter in installation. It is of sufficient height when supported on the gutter support 28 to position the cover section 34 in a downwardly sloping direction toward the front. This will cause nuts, leaves and other debris to be pitched to the front and fall off the gutter.

A front section 36 is constructed to butt against an edge 38 of the gutter lip toward a corner 40 of the gutter support and gutter wall corner 41 to effect a two fold spring biasing action against the front of the gutters. This is effected by the somewhat L-shaped construction of the front section comprising a foot portion 42 butting against the lip edge 38 and a leg portion 44 which butts against the gutter support corner 40 and toward the gutter wall between the gutter supports in spaced relation under the lip edge. This two fold spring biasing action in conjunction with the biasing action of the rear section 35 against the rear 31 of the gutter support and the side wall 14 of the building provides three spring biased forces which retain the gutter screen in the gutter.

Figure 4:
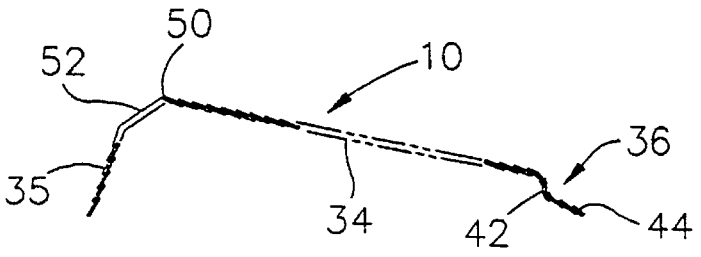
FIG. 4 is a view similar to FIG. 1 showing a modified screen.

To effect a more easily flexed screen for installation, the cover may be provided with a crown 50 extending longitudinally along the gutter screen. The crown is positioned under the roof close to the rear section of the gutter as shown in FIG. 4 to provide a short section 52 separated from the cover section 34 by the crown 50. As shown in FIG. 4 the crown is simply a bend or shoulder joining the sections to facilitate bending. This provides a further ease in flexing for installation in addition to the bend or shoulder at the junction of sections 34 and 35, shown in FIGS. 1 and 4.

Figure 5:
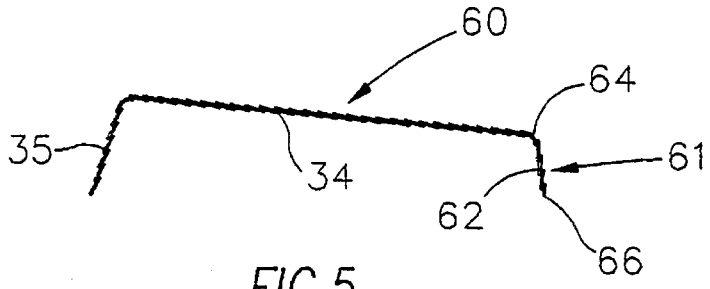
FIG. 5 is a view similar to FIG. 1 showing a further modified screen.
Figure 6:
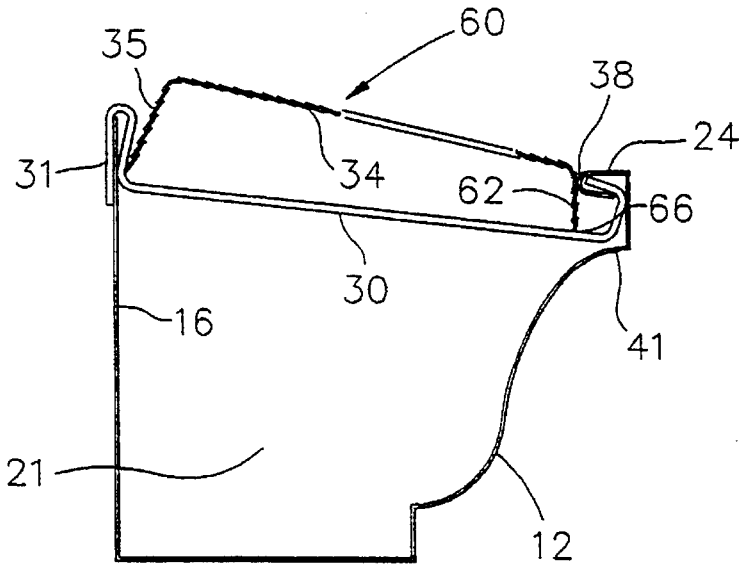
FIG. 6 is a view in cross-section of a gutter provided with the screen of FIG. 5.

A further modification is shown in FIGS. 5 and 6. This modification is employed where the stiffness of the screen makes it difficult to flex and install in the gutter. The screen, which is generally indicated by the reference numeral 60, has substantially the same rear section 35 and intermediate sloping cover section 34 as screen 10 in FIGS. 1, 2 and 3. The forward section 61, however, is comprised of single downwardly and slightly forwardly sloping steep wall 62 connected to the cover section at a bend or joint 64. The wall is of such a length that in installation, the top portion of the wall 62 butts at the joint and slightly below it against the edge 38 of the gutter lip and the bottom edge 66 is supported upon and biased against the gutter support section 30 under the gutter lip. The front wall is biased by the flexibility of the screen against both the gutter edge and the gutter support to provide two biasing points. This forms with the biasing of the rear wall against the back of the gutter support and the gutter a three fold biasing combination to firmly engage the screen within the gutter.

USE

The gutter screen 10 of this invention is simply installed after the gutter is attached to the house with the gutter support. The screen is placed in the gutter on top of the gutter support with the rear section under the edge of the roof and upon the top of the gutter support, and the forward portion is then bent rearwardly and downwardly nested against the lip edge and against the top of the gutter support. This provides a biased two fold contact at the front of the gutter.

The flexing of the rear portion against the rear of the gutter support and the rear wall of the gutter effects the third spring loaded biasing force to maintain the gutter screen firmly secured within the top of the gutter and top of the gutter support.

Where desired, the modification of FIG. 4 employing the gutter screen with the crown 50, may be employed. In some installations, depending on the roof overhang, the greater ease in flexing the cover 34 of the screen, simplifies installation.

The further modification of FIGS. 5 and 6 provide a further advantage in ease in installation. The screen need not be flexed toward the rear to the extent of the screens of FIGS. 1–4. The front section does not extend as far to the front as those screens and is more easily inserted within the gutter lip and pushed downwardly against the gutter support and the gutter wall between the gutter supports due to the slight sag of the screen between the supports. The three fold biasing action is effected to hold it firmly within the gutter.

Removal of the gutter screens is effected by the reverse of the above procedures with the screen 60 being easiest to remove. If necessary, a tool may be inserted in the hole of the screen to bear against the screen to lift it upwardly and out of the gutter.

Various changes and modifications may be made within this invention as will be apparent to those skilled in the art. Such changes and modifications are within the scope and teaching of this invention as defined in the claims appended hereto.

What is claimed is:

1. A gutter screen, gutter and gutter support, said gutter having a vertical rear wall adapted to be attached to a wall of a building by said gutter support connecting a front and rear wall of the gutter, said gutter support extending through a longitudinal gutter trough formed in the gutter under an inwardly turned lip of the gutter, said screen having a substantially vertical rear section sloping slightly toward and biased against the rear wall of the gutter and supported on top of said gutter support, a downwardly sloping substantially flat intermediate cover section covering an open portion of the gutter trough and extending to a flush position with said lip of the gutter and a forward section having a shoulder portion formed at a junction with said intermediate section, said shoulder being butted transversely and biased against an edge of said lip and said forward section extending underneath said lip in biased relation thereto.

2. The screen of claim 1 in which the forward edge of the intermediate section is butted against an inner edge of the lip of the gutter and the intermediate section and a top wall of the lip are substantially co-extensive.

3. The screen of claim 1 in which the cover section is comprised of a narrow rear portion and a wide forward portion angularly disposed to said rear portion and separated by a crown in the form of a shoulder bend located to the rear of a front of a roof to facilitate bending of the gutter screen for installation in the gutter.

4. The screen of claim 1 in which the forward section has a bottom edge biased against the gutter support.

5. The screen of claim 4 in which the forward section is of a length between a shoulder connecting it to the cover section and a bottom edge of the forward section to support the intermediate cover section substantially co-extensive with the gutter lip.

6. A gutter screen, gutter and gutter support, said gutter having a vertical rear wall adapted to be attached to a wall of a building by said gutter support connecting a front and rear wall of the gutter, said gutter support extending through a longitudinal gutter trough formed in the gutter under an inwardly turned lip of the gutter, said screen having a substantially vertical rear section sloping slightly toward and biased against the rear wall of the gutter and supported on top of said gutter support, a downwardly sloping substantially flat intermediate cover section covering an open portion of the gutter trough and extending to a flush position with said lip of the gutter and a forward section having a shoulder portion formed at a junction with said intermediate section, said shoulder being butted transversely and biased against an edge of said lip and said forward section extending underneath said lip in biased relation thereto, said screen being biased at a forward edge toward an interior wall of the gutter underneath the gutter lip, said screen being biased at a forward edge against the gutter support within a vertical wall of the gutter, the forward edge of the screen being spaced underneath the gutter lip.

7. A gutter screen, gutter and gutter support, said gutter having a vertical rear wall adapted to be attached to a wall of a building by said gutter support connecting a front and rear wall of the gutter, said gutter support extending through a longitudinal gutter trough formed in the gutter under an inwardly turned lip of the gutter, said screen having a substantially vertical rear section sloping slightly toward and biased against the rear wall of the gutter and supported on top of said gutter support, a downwardly sloping substantially flat intermediate cover section covering an open portion of the gutter trough and extending to a flush position with said lip of the gutter and a forward section having a shoulder portion formed at a junction with said intermediate section, said shoulder being butted transversely and biased against an edge of said lip and said forward section extending underneath said lip in biased relation thereto, the forward section of the screen having a bottom edge biased against the gutter support, said forward section being a straight substantially flat wall sloping steeply downward from the cover section and connected thereto by said shoulder.

* * * * *